US011402112B2

(12) United States Patent
Yamanaka et al.

(10) Patent No.: US 11,402,112 B2
(45) Date of Patent: Aug. 2, 2022

(54) HEAT EXCHANGE UNIT AND AIR-CONDITIONING APPARATUS

(71) Applicant: Mitsubishi Electric Corporation, Tokyo (JP)

(72) Inventors: Tatsuya Yamanaka, Tokyo (JP); Shigeo Takata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 90 days.

(21) Appl. No.: 16/609,795

(22) PCT Filed: Jul. 4, 2017

(86) PCT No.: PCT/JP2017/024487
§ 371 (c)(1),
(2) Date: Oct. 31, 2019

(87) PCT Pub. No.: WO2019/008667
PCT Pub. Date: Jan. 10, 2019

(65) Prior Publication Data

US 2020/0326087 A1 Oct. 15, 2020

(51) Int. Cl.
*F24F 1/0007* (2019.01)
*F24F 1/24* (2011.01)
(Continued)

(52) U.S. Cl.
CPC ..... *F24F 11/42* (2018.01); *F24F 1/00077* (2019.02); *F24F 1/10* (2013.01);
(Continued)

(58) Field of Classification Search
CPC ..... F24F 1/24; F25B 7/00; F25B 2600/2501
See application file for complete search history.

(56) References Cited

U.S. PATENT DOCUMENTS 9,677,789 B2 * 6/2017 Joppolo ..... F25D 11/022
10,240,839 B2 * 3/2019 Sykora ..... F25B 31/006
(Continued)

FOREIGN PATENT DOCUMENTS

EP 0 509 844 A1 10/1992
EP 2 306 101 A1 4/2011
(Continued)

OTHER PUBLICATIONS

Office Action dated Sep. 1, 2020 issued in corresponding JP patent application No. 2019-528230 (and English translation).
(Continued)

*Primary Examiner* — Ana M Vazquez
(74) *Attorney, Agent, or Firm* — Posz Law Group, PLC

(57) ABSTRACT

An air-conditioning apparatus includes a refrigerant circuit in which a compressor, a heat-source-side heat exchanger, a heat-source-side expansion device, and a circuit-circuit heat exchanger are connected via a refrigerant pipe and refrigerant circulates, and a heat medium circuit in which a pump, the circuit-circuit heat exchanger, a load-side expansion device, and a load-side heat exchanger are connected via a heat medium pipe and a heat medium circulates. The air-conditioning apparatus includes a radiator that is connected to the heat medium pipe and a control unit that is attached to the radiator. The circuit-circuit heat exchanger exchanges heat between the refrigerant circulating in the refrigerant circuit and the heat medium circulating in the heat medium circuit. The control unit is cooled via the radiator by the heat medium flowing in the heat medium pipe.

6 Claims, 8 Drawing Sheets

(51) Int. Cl.

| | |
|---|---|
| ***F24F 1/32*** | (2011.01) |
| ***F24F 11/42*** | (2018.01) |
| ***F24F 1/10*** | (2011.01) |
| ***F24F 1/16*** | (2011.01) |
| ***F24F 13/30*** | (2006.01) |
| *F24F 140/20* | (2018.01) |

(52) U.S. Cl.
CPC ..... *F24F 1/16* (2013.01); *F24F 1/24* (2013.01); *F24F 1/32* (2013.01); *F24F 13/30* (2013.01); *F24F 2140/20* (2018.01); *F24F 2221/34* (2013.01)

(56) References Cited

U.S. PATENT DOCUMENTS

| | | | | |
|---|---|---|---|---|
| 2012/0151949 | A1* | 6/2012 | Yamashita | F25B 25/005 62/238.7 |
| 2012/0180515 | A1* | 7/2012 | Morimoto | F25B 41/24 62/504 |
| 2012/0297806 | A1* | 11/2012 | Honda | F25B 30/02 62/222 |
| 2013/0174594 | A1 | 7/2013 | Yamashita et al. | |
| 2013/0255932 | A1* | 10/2013 | Doepker | F28D 15/00 165/287 |
| 2015/0034293 | A1* | 2/2015 | Takayama | F24F 11/83 165/207 |
| 2015/0059389 | A1 | 3/2015 | Liu et al. | |
| 2015/0176866 | A1* | 6/2015 | Takayama | F25B 49/02 62/140 |
| 2017/0021698 | A1* | 1/2017 | Hatakeyama | B60H 1/143 |
| 2017/0030619 | A1* | 2/2017 | Kim | F28D 1/0477 |
| 2017/0248349 | A1* | 8/2017 | Kujak | F25B 9/002 |

FOREIGN PATENT DOCUMENTS

| | | | |
|---|---|---|---|
| EP | 2 787 297 | A1 | 10/2014 |
| JP | H04-320399 | A | 11/1992 |
| JP | H05-322224 | A | 12/1993 |
| JP | 2008-002741 | A | 1/2008 |
| JP | 2009-209893 | A | 9/2009 |
| WO | 2012/070192 | A1 | 5/2012 |

OTHER PUBLICATIONS

Extended European Search Report dated Mar. 27, 2020 issued in corresponding European patent application No. 17916825.7.
International Search Report of the International Searching Authority dated Sep. 5, 2017 for the corresponding International application No. PCT/JP2017/024487 (and English translation).
Office Action dated Nov. 4, 2020 issued in corresponding CN patent application No. 201780092590.7 (and English translation).

* cited by examiner

HEAT EXCHANGE UNIT AND AIR-CONDITIONING APPARATUS

CROSS REFERENCE TO RELATED APPLICATION

This application is a U.S. national stage application of PCT/JP2017/024487 filed on Jul. 4, 2017, the contents of which are incorporated herein by reference.

TECHNICAL FIELD

The present invention relates to a heat exchange unit and an air-conditioning apparatus that are equipped with a heat exchanger that exchanges heat between refrigerant and a heat medium.

BACKGROUND ART

Some heat exchange unit and some air-conditioning apparatus including this heat exchange unit have been supplied with a control unit equipped with a semiconductor device including a switching element, the control unit being used for driving a motor. The control unit reaches high temperatures due to, for example, an operation of the switching element, and thus needs to be cooled to suppress the occurrence of breakdowns and malfunctions. As a cooling method to this end, an air cooling method is known (for example, see Patent Literature 1). In an air-conditioning apparatus in Patent Literature 1, a control unit is adhered to a heat sink, and the control unit is cooled by air sent to the heat sink from a fan.

CITATION LIST

Patent Literature

Patent Literature 1: Japanese Unexamined Patent Application Publication No. 5-322224

SUMMARY OF INVENTION

Technical Problem

However, in a case where an air cooling method is used as in Patent Literature 1, there is a problem in that an air-conditioning apparatus structurally increases in size because it is necessary to mount a heat sink and have an air path. In addition, in a case where the control unit is installed in a space where it is difficult to maintain ventilation such as above a ceiling, there is a problem in that heat generated at the control unit cannot be efficiently transferred as heat stays in a space such as above the ceiling.

The present invention has been made to solve problems as described above, and an object of the present invention is to provide a heat exchange unit and an air-conditioning apparatus that can prevent the air-conditioning apparatus from structurally increasing in size and that can efficiently discharge heat generated at a control unit.

Solution to Problem

A heat exchange unit according to an embodiment of the present invention is a heat exchange unit that is connected via a refrigerant pipe to an outdoor unit including a compressor and a heat-source-side heat exchanger and that is connected via a heat medium pipe to an indoor unit including a load-side expansion device and a load-side heat exchanger, the heat exchange unit includes a heat-source-side expansion device, a circuit-circuit heat exchanger, a pump, a radiator that is connected to the heat medium pipe, and a control unit that is attached to the radiator and controls the pump, the heat-source-side expansion device and the circuit-circuit heat exchanger are connected to the compressor and the heat-source-side heat exchanger via the refrigerant pipe and form a refrigerant circuit in which refrigerant circulates, the pump and the circuit-circuit heat exchanger are connected to the load-side expansion device and the load-side heat exchanger via the heat medium pipe and form a heat medium circuit in which a heat medium circulates, the circuit-circuit heat exchanger exchanges heat between the refrigerant circulating in the refrigerant circuit and the heat medium circulating in the heat medium circuit, and the control unit is cooled via the radiator by the heat medium flowing in the heat medium pipe.

An air-conditioning apparatus according to an embodiment of the present invention includes a refrigerant circuit in which a compressor, a heat-source-side heat exchanger, a heat-source-side expansion device, and a circuit-circuit heat exchanger are connected via a refrigerant pipe and refrigerant circulates, a heat medium circuit in which a pump, the circuit-circuit heat exchanger, a load-side expansion device, and a load-side heat exchanger are connected via a heat medium pipe and a heat medium circulates, a radiator that is connected to the heat medium pipe, and a control unit that is attached to the radiator, the circuit-circuit heat exchanger exchanges heat between the refrigerant circulating in the refrigerant circuit and the heat medium circulating in the heat medium circuit, and the control unit is cooled via the radiator by the heat medium flowing in the heat medium pipe.

Advantageous Effects of Invention

According to an embodiment of the present invention, as the control unit is attached to the radiator connected to the heat medium pipe, the control unit is cooled by the heat medium circulating through the heat medium circuit via the indoor unit, and thus no air path needs to be provided. Thus, the upsizing and breakdowns of the air-conditioning apparatus can be suppressed, and heat generated at the control unit can be efficiently transferred.

DESCRIPTION OF EMBODIMENTS

Embodiment 1

Figure 1:
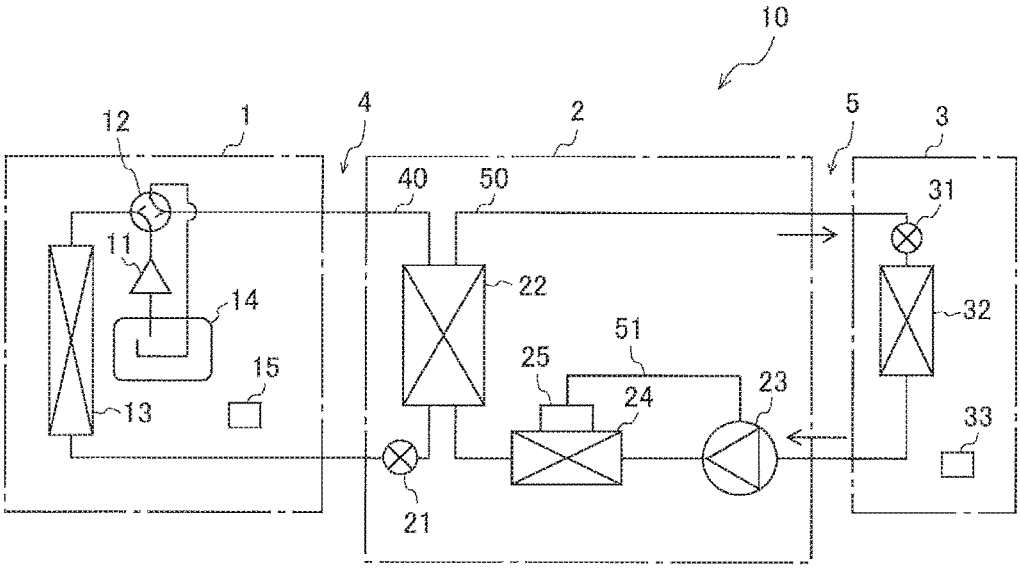
FIG. 1 is a schematic diagram illustrating an example of the configuration of an air-conditioning apparatus according to Embodiment 1 of the present invention.

FIG. 1 is a schematic diagram illustrating an example of the configuration of an air-conditioning apparatus according to Embodiment 1 of the present invention. As illustrated in FIG. 1, an air-conditioning apparatus 10 includes an outdoor unit 1, a heat exchange unit 2, and an indoor unit 3.

The outdoor unit 1 has a compressor 11, a four-way valve 12, a heat-source-side heat exchanger 13, an accumulator 14, and an outdoor controller 15. The heat exchange unit 2 has a heat-source-side expansion device 21, a circuit-circuit heat exchanger 22, a pump 23, a radiator 24, and a control unit 25. The indoor unit 3 has a load-side expansion device 31, a load-side heat exchanger 32, and an indoor controller 33. In the indoor unit 3, the load-side expansion device 31 and the load-side heat exchanger 32 are connected in series by a heat medium pipe 50.

In addition, the air-conditioning apparatus 10 has a refrigerant circuit 4 and a heat medium circuit 5. In the refrigerant circuit 4, the compressor 11, the heat-source-side heat exchanger 13, the heat-source-side expansion device 21, and the circuit-circuit heat exchanger 22 are connected via a refrigerant pipe 40, and the refrigerant circuit 4 is formed in such a manner that refrigerant circulates. In the heat medium circuit 5, the pump 23, the circuit-circuit heat exchanger 22, the load-side expansion device 31, and the load-side heat exchanger 32 are connected via the heat medium pipe 50, and the heat medium circuit 5 is formed in such a manner that a heat medium circulates. As the heat medium, for example, water or brine can be used.

The compressor 11 has a compressor motor (not illustrated) driven by an inverter, and suctions and compresses refrigerant. The four-way valve 12 is connected to the compressor 11, and switches the flow directions of refrigerant under control performed by the outdoor controller 15. In a heating operation mode in which heating energy is supplied to the indoor unit 3, the outdoor controller 15 causes the four-way valve 12 to switch flow paths to ones represented by solid lines in FIG. 1. In contrast, in a cooling operation mode in which cooling energy is supplied to the indoor unit 3, the outdoor controller 15 causes the four-way valve 12 to switch the flow paths to the other ones represented by broken lines in FIG. 1.

The heat-source-side heat exchanger 13 includes, for example, a fin-and-tube heat exchanger, and exchanges heat between refrigerant flowing in the refrigerant circuit 4 and outdoor air. The accumulator 14 is connected between the four-way valve 12 and the compressor 11, and stores excess refrigerant. In addition, the accumulator 14 suppresses the flow of liquid refrigerant into the compressor 11 and operates to prevent the compressor 11 from being damaged. The outdoor controller 15 controls the outdoor unit 1. In Embodiment 1, the outdoor controller 15 is configured to control operations of the compressor 11 and the four-way valve 12.

The heat-source-side expansion device 21 includes, for example, an electronic expansion valve, and expands refrigerant by performing pressure reduction. The heat-source-side expansion device 21 is attached to the refrigerant pipe 40. The circuit-circuit heat exchanger 22 is connected between the refrigerant circuit 4 and the heat medium circuit 5. The circuit-circuit heat exchanger 22 exchanges heat between the refrigerant circulating through the refrigerant circuit 4 and the heat medium circulating through the heat medium circuit 5.

The pump 23 applies pressure for circulating the heat medium inside the heat medium circuit 5. The pump 23 has a motor 23*a* driven by an inverter (see FIG. 2), and is driven using the motor 23*a* as a power source. That is, the pump 23 is used to circulate the heat medium through the heat medium circuit 5, and is operated in accordance with an output from the control unit 25. FIG. 1 illustrates, as an example, a case where the pump 23 is located downstream of the radiator 24.

The radiator 24 is provided closer to an inlet than an outlet of the circuit-circuit heat exchanger 22. That is, the radiator 24 is located at part of the heat medium pipe 50 from downstream of the load-side heat exchanger 32 to the inlet of the circuit-circuit heat exchanger 22. The radiator 24 is formed by a plate-like body, and one surface of the radiator 24 is connected to the heat medium pipe 50 and the other surface is in contact with the control unit 25. The radiator 24 exchanges heat between the control unit 25 and the heat medium flowing in the heat medium circuit 5.

The control unit 25 controls an operation of the pump 23 by using an inverter, and is attached to the radiator 24. An output terminal of the control unit 25 and an input terminal of the pump 23 are connected by an inverter power wire 51. The control unit 25 is used as a power conversion device and can freely adjust a voltage to be applied to the motor 23*a* and the rotational frequency of the motor 23*a*. The control unit 25 has a heat sink plate (not illustrated), and is located in such a manner that the heat sink plate is in contact with the radiator 24. That is, the control unit 25 is thermally connected to the heat medium pipe 50 via the radiator 24, and is cooled via the radiator 24 by the heat medium flowing in the heat medium pipe 50.

More specifically, the radiator 24 is formed by a plate-like body, and in its surface facing the heat medium pipe 50 a groove portion into which the heat medium pipe 50 is inserted is formed. In Embodiment 1, the heat medium pipe 50 has, at a position facing the radiator 24, a meandering shape obtained by folding the heat medium pipe 50 a plurality of times to increase the area of the heat medium pipe 50 contacting the radiator 24 and increase heat exchange efficiency. Part or the entirety of the heat medium pipe 50 is inserted into the groove portion of the radiator 24. Note that, for example, thermal grease may also be used to improve adhesion between the radiator 24 and the heat medium pipe 50.

In addition, the surface of the radiator 24 facing the control unit 25 is planar and is in contact with the heat sink plate of the control unit 25. In this manner, as the surface of the radiator 24 facing the control unit 25 is planar, the radiator 24 can adhere to the heat sink plate of the control unit 25, and thus heat of the control unit 25 can be efficiently transferred. Note that, for example, a heat transfer sheet or thermal grease may also be used to improve adhesion between the radiator 24 and the heat sink plate of the control unit 25.

The load-side expansion device 31 adjusts the amount of a heat medium flowing into the load-side heat exchanger 32. The load-side expansion device 31 is located downstream of the circuit-circuit heat exchanger 22 and upstream of the load-side heat exchanger 32. The load-side heat exchanger 32 includes, for example, a fin-and-tube heat exchanger, and exchanges heat between the heat medium flowing in the heat medium circuit 5 and indoor air. The indoor controller 33 adjusts the opening degree of the load-side expansion device 31.

That is, the outdoor unit 1 is located outdoors and is used as a heat source device that supplies heating energy or cooling energy to the indoor unit 3 via the heat exchange unit 2. The heat exchange unit 2 is a device that exchanges heat between refrigerant whose temperature becomes high or low at the outdoor unit 1 and the heat medium circulating through the heat medium circuit 5 via the indoor unit 3 and supplies heating energy or cooling energy to the indoor unit 3. The heat exchange unit 2 may be located indoors or outdoors. The indoor unit 3 is located in an air-conditioned space such as a room, that is, indoors, and adjusts air environment such as the temperature and humidity inside the air-conditioned space. The outdoor unit 1 and the heat exchange unit 2 are connected by the refrigerant pipe 40. The heat exchange unit 2 and the indoor unit 3 are connected by the heat medium pipe 50.

In addition, the outdoor controller 15, the control unit 25, and the indoor controller 33 are configured in such a manner that communication is possible with each other. The outdoor controller 15, the control unit 25, and the indoor controller 33 are configured to execute the cooling operation mode, the heating operation mode, and a defrosting operation mode in cooperation with each other.

Figure 2:
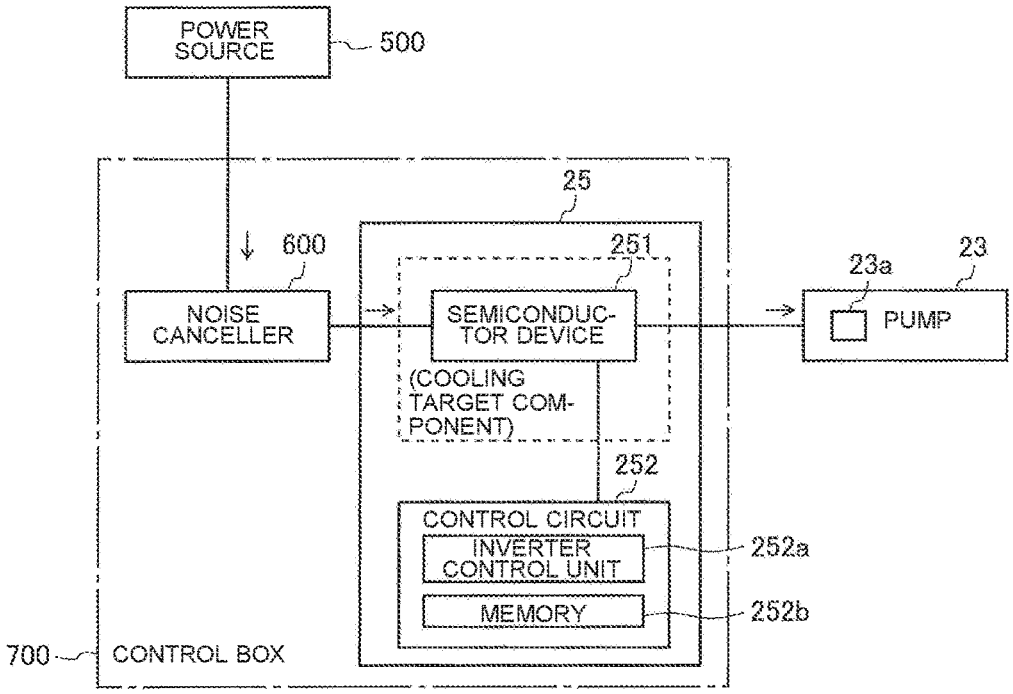
FIG. 2 is a block diagram illustrating an example of a specific configuration of a control unit of FIG. 1 and around the control unit.

FIG. 2 is a block diagram specifically illustrating an example of the configuration of the control unit of FIG. 1 and around the control unit. As illustrated in FIG. 2, the control unit 25 is connected to a power source 500 such as a commercial power source via a noise canceller 600. Note that the noise canceller 600 suppresses noises flowing into the power source 500 from the control unit 25. In Embodiment 1, the control unit 25 and the noise canceller 600 are housed in a control box 700.

The control unit 25 has a semiconductor device 251 including a rectifier diode and a switching element and a control circuit 252 including a microcomputer. The semiconductor device 251 is used as a power conversion device that converts power supplied from the power source 500 into power for driving the motor 23*a*. As the switching element of the semiconductor device 251, for example, a metal-oxide-semiconductor field-effect transistor (MOSFET) or an insulated gate bipolar transistor (IGBT) may be employed. In Embodiment 1, the semiconductor device 251 is a cooling target component. That is, the semiconductor device 251 is located in a state in which the semiconductor device 251 is in contact with the radiator 24 of FIG. 1, and is configured in such a manner that heat generated at the semiconductor device 251 is transferred through the radiator 24.

The control circuit 252 has an inverter control unit 252*a* for controlling the semiconductor device 251 and a memory 252*b* for storing a program for operating the inverter control unit 252*a* and various types of information. The semiconductor device 251 and the inverter control unit 252*a* constitute an inverter control circuit. The inverter control unit 252*a* may include, for example, a digital signal processor (DSP). The memory 252*b* may include, for example, a random access memory (RAM) and a read only memory (ROM), a programmable read only memory (PROM) such as a flash memory, or a hard disk drive (HDD).

(Description of Operation)

The air-conditioning apparatus 10 exchanges heat between refrigerant that has exchanged heat with outdoor air at the outdoor unit 1 and a heat medium flowing inside the circuit-circuit heat exchanger 22 of the heat exchange unit 2, and furthermore exchanges heat between a heat medium and indoor air at the load-side heat exchanger 32 of the indoor unit 3.

In the case of the cooling operation mode in which the outdoor unit 1 supplies cooling energy to the load side, the refrigerant that is discharged from the compressor 11 and that is caused to be in a low-temperature and low-pressure state by the heat-source-side heat exchanger 13 and the heat-source-side expansion device 21 receives heat from the heat medium passing through the circuit-circuit heat exchanger 22 when the refrigerant passes through the circuit-circuit heat exchanger 22. The heat medium from which heat has been taken away at the circuit-circuit heat exchanger 22 and whose temperature becomes low is discharged from the circuit-circuit heat exchanger 22, flows through the heat medium pipe 50, and flows into the load-side heat exchanger 32 via the load-side expansion device 31. The temperature of the heat medium flowing into the load-side heat exchanger 32 rises up to about room temperature at the load-side heat exchanger 32. The heat medium that has passed through the load-side heat exchanger 32 passes through a location where the pump 23 and the radiator 24 are located and returns to the circuit-circuit heat exchanger 22 again. In this case, the heat exchange unit 2 transfers heat generated at the pump 23 and the radiator 24 to the heat medium inside the heat medium pipe 50.

In the case of the heating operation mode in which the outdoor unit 1 supplies heating energy to the load side, the refrigerant that is caused to be in a high-temperature and high-pressure state by the compressor 11 transfers heat to the heat medium passing through the circuit-circuit heat exchanger 22 when the refrigerant passes through the circuit-circuit heat exchanger 22. The heat medium that has received heat at the circuit-circuit heat exchanger 22 and whose temperature becomes high is discharged from the circuit-circuit heat exchanger 22, flows through the heat medium pipe 50, and flows into the load-side heat exchanger 32 via the load-side expansion device 31. The temperature of the heat medium flowing into the load-side heat exchanger 32 decreases down to about room temperature at the load-side heat exchanger 32. The heat medium that has passed through the load-side heat exchanger 32 passes through the location where the pump 23 and the radiator 24 are located and returns to the circuit-circuit heat exchanger 22. In this case, similarly to as in the case of the heating operation mode, the heat exchange unit 2 transfers heat generated at the pump 23 and the radiator 24 to the heat medium inside the heat medium pipe 50.

That is, the air-conditioning apparatus 10 can efficiently cool the control unit 25 in either of the cooling operation mode and the heating operation mode. Note that, in a case where the temperature of the heat-source-side heat exchanger 13 becomes lower than a reference temperature in the heating operation mode, the air-conditioning apparatus 10 is configured to enter the defrosting operation mode, in which the heat-source-side heat exchanger 13 is defrosted.

As described above, as the control unit 25 is attached to the radiator 24 connected to the heat medium pipe 50 in the air-conditioning apparatus 10, the control unit 25 is cooled by the heat medium circulating through the heat medium circuit 5 via the indoor unit 3. Thus, for example, no air path needs to be provided. As a result, the upsizing and breakdowns of the air-conditioning apparatus can be suppressed, and heat generated at the control unit 25 can be efficiently transferred.

That is, in the air-conditioning apparatus 10, the control unit 25 is configured to transfer heat generated, by, for example, a switching operation, to the heat medium circuit 5. Thus, even in a case where the heat exchange unit 2 is installed in an enclosed space such as an attic, the control unit 25 can transfer heat to the heat medium flowing in the heat medium circuit 5. As a result, an increase in temperature around electrical components inside the heat exchange unit 2 can be suppressed. Thus, the cooling efficiency of the control unit 25 can be improved and also the capacity of the control unit 25 can be increased. In addition, no heat sink and no fan for circulating air need to be added to transfer heat from the control unit 25, and thus the air-conditioning apparatus 10 can be structurally reduced in size, its cost can be reduced, and its space can be saved.

Furthermore, in Embodiment 1, the radiator 24 is provided closer to the inlet than the outlet of the circuit-circuit heat exchanger 22 in the heat medium circuit 5. In either of the heating operation mode and the cooling operation mode, the heat medium that has exchanged heat with indoor air at the load-side heat exchanger 32 flows in the radiator 24, and thus the temperature of the radiator 24 can be always maintained at room temperature. Consequently, the state of the control unit 25, which is in contact with the radiator 24, can be always maintained at 100 degrees C. or lower.

In a case where a refrigerant cooling method is used as a method for cooling a control unit, there is a problem in that condensation caused by overcooling enters electrical components, such as the control unit, which leads to breakdowns of the electrical components. In terms of this point, the air-conditioning apparatus 10 according to Embodiment 1 can use the heat medium whose temperature is about room temperature to transfer heat from the control unit 25. Consequently, the occurrence of condensation due to overcooling can be prevented and thus breakdowns of the control unit 25 and other electrical components due to the entry of condensed water can be prevented.

The radiator 24 may also be located at the heat medium pipe 50 from the circuit-circuit heat exchanger 22 to the load-side expansion device 31 in the heat medium circuit 5. Even in this manner, the temperature of the heat medium flowing in the heat medium pipe 50 is sufficiently lower than the temperature of the semiconductor device 251, which is a heating element, and thus the control unit 25 can be cooled. When such a configuration is employed, the control unit 25 can be efficiently cooled especially in the case of the cooling operation mode. In addition, the radiator 24 may also be located at the heat medium pipe 50 from downstream of the load-side heat exchanger 32 to the outlet of the circuit-circuit heat exchanger 22.

The inlet of the circuit-circuit heat exchanger 22 is closer to the load-side heat exchanger 32 than is the outlet of the circuit-circuit heat exchanger 22. Thus, at the inlet of the circuit-circuit heat exchanger 22, either at the time of cooling or at the time of heating, the temperature of the heat medium flowing in the heat medium pipe 50 is maintained at the same level as the temperature of indoor air. As a result, preferably, the radiator 24 is located at part of the heat medium pipe 50 from downstream of the load-side heat exchanger 32 to the inlet of the circuit-circuit heat exchanger 22. Furthermore, the radiator 24 may also be located at the outlet or inlet of the circuit-circuit heat exchanger 22 or may be incorporated into the circuit-circuit heat exchanger 22. In addition, the radiator 24 may also be built in the pump 23, and may transfer heat from the control unit 25 to the heat medium flowing in the pump 23.

Embodiment 2

Figure 3:
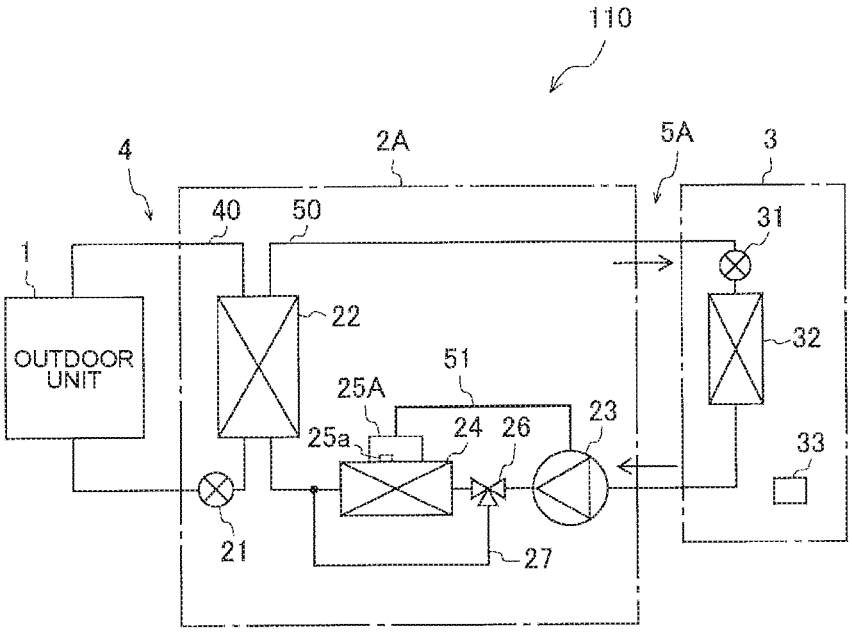
FIG. 3 is a schematic diagram illustrating an example of the configuration of an air-conditioning apparatus according to Embodiment 2 of the present invention.
Figure 4:
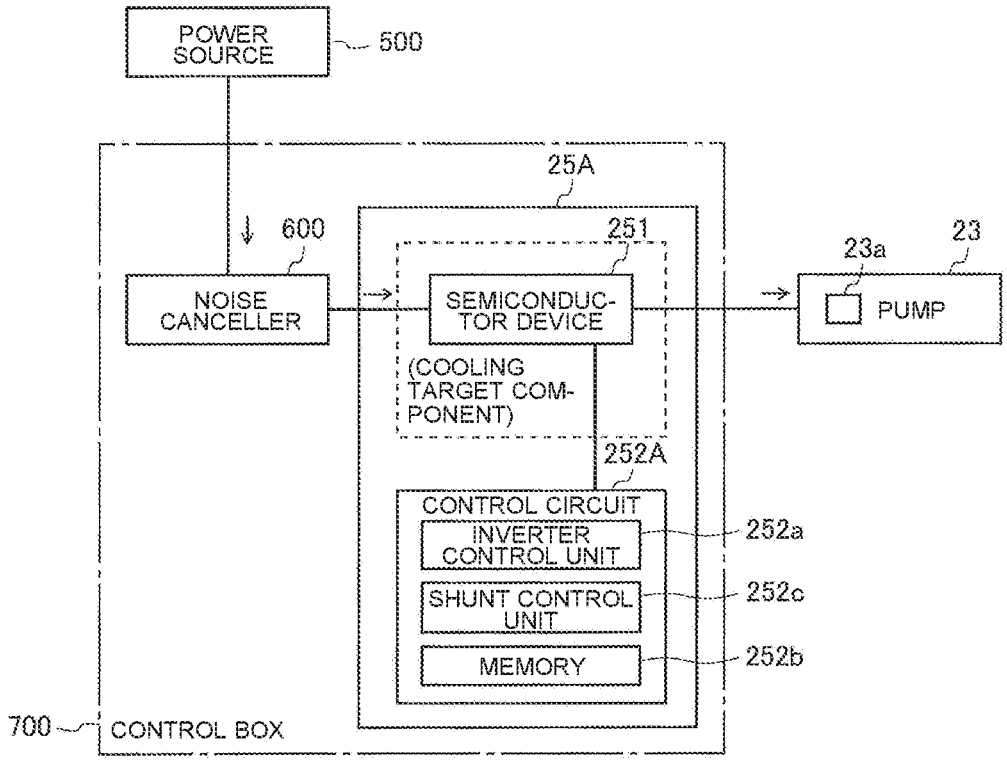
FIG. 4 is a block diagram illustrating an example of a specific configuration of a control unit of FIG. 3 and around the control unit.

FIG. 3 is a schematic diagram illustrating an example of the configuration of an air-conditioning apparatus according to Embodiment 2 of the present invention. FIG. 4 is a block diagram specifically illustrating an example of the configuration of the control unit of FIG. 3 and around the control unit. The configuration of an air-conditioning apparatus 110 according to Embodiment 2 will be described with reference to FIGS. 3 and 4. Components that are substantially the same as those of the air-conditioning apparatus 10 in Embodiment 1 described above will be denoted by the same reference signs and the description of the components will be omitted.

A heat exchange unit 2A has a shunt 26 and a bypass pipe 27 on a heat medium circuit 5. The bypass pipe 27 is a pipe that has one end portion that connects part close to an inlet of the radiator 24 and the other end portion that connects part close to an outlet of the radiator 24 and that bypasses the radiator 24. That is, the one end portion of the bypass pipe 27 is connected to the shunt 26, the other end portion is connected to part of the heat medium pipe 50 between the radiator 24 and the circuit-circuit heat exchanger 22. The shunt 26 is installed closer to the inlet than the outlet of the radiator 24 and is for splitting a heat medium flowing in from upstream of the radiator 24 into a flow to the radiator 24 and a flow to the bypass pipe 27.

A control unit 25A includes a thermistor, and a passing temperature sensor 25*a* configured to measure a passing temperature that is the temperature of a heat medium passing through the radiator 24 is built in the control unit 25A. The passing temperature sensor 25*a* is configured to measure, as a passing temperature, the temperature of the heat sink plate of the control unit 25A.

The control unit 25A has a shunt control unit 252*c* inside a control circuit 252A. The shunt control unit 252*c* adjust the split ratio of the shunt 26 in accordance with the temperature of the heat medium passing through the radiator 24.

In Embodiment 2, a memory 252*b* prestores an increase threshold that is used as a reference when the flow rate of the heat medium to the radiator 24 is increased and a decrease threshold that is used as a reference when the flow rate of the heat medium to the radiator 24 is decreased. The decrease threshold is set to a temperature lower than the increase threshold. The increase threshold and the decrease threshold can be changed as necessary in accordance with the configuration of the air-conditioning apparatus 110 and its installation environment.

In a case where the passing temperature measured at the passing temperature sensor 25*a* is greater than the increase threshold, the shunt control unit 252*c* adjusts the split ratio of the shunt 26 in such a manner that the flow rate of the heat medium to the radiator 24 increases. In contrast, in a case where the passing temperature is smaller than the decrease threshold, the shunt control unit 252*c* adjusts the split ratio of the shunt 26 in such a manner that the flow rate of the heat medium to the radiator 24 decreases, that is, the flow rate of the heat medium to the bypass pipe 27 increases.

When the shunt control unit 252*c* adjusts the split ratio of the shunt 26, the shunt control unit 252*c* may increase or decrease the amount of heat medium to flow into the radiator 24 by a preset constant amount. In addition, the memory 252*b* may store a split ratio table in which temperature differences from the increase threshold and the decrease threshold are associated with the split ratios of the shunt 26. In this case, in a case where the passing temperature is greater than the increase threshold, the control unit 25A may acquire the temperature difference between the passing temperature and the increase threshold. Likewise, in a case where the passing temperature is smaller than the decrease threshold, the control unit 25A may acquire the temperature difference between the passing temperature and the decrease threshold. The control unit 25A may then acquire the split ratio of the shunt 26 by checking the acquired temperature difference against the split ratio table, and may control the shunt 26 in accordance with the acquired split ratio.

In this case, preferably, the split ratio table is designed in such a manner that an increase in the flow rate of the heat medium to the radiator 24 becomes large when the temperature difference between the passing temperature and the increase threshold increases and that a decrease in the flow rate of the heat medium to the radiator 24 becomes large when the temperature difference between the passing temperature and the decrease threshold increases. The increase threshold and the decrease threshold may each be associated with a split ratio table. Note that one split ratio table is enough when the control unit 25A acquires the temperature difference between the passing temperature and the increase threshold by subtracting the increase threshold from the passing temperature and the temperature difference between the passing temperature and the decrease threshold by subtracting the decrease threshold from the passing temperature. This is because the value obtained by subtracting the increase threshold from the passing temperature is always positive and the value obtained by subtracting the decrease threshold from the passing temperature is always negative.

The configuration of the rest of the heat exchange unit 2A and that of the heat medium circuit 5A are substantially the same as that of the heat exchange unit 2 and that of the heat medium circuit 5 of Embodiment 1, respectively. That is, the configuration of the rest of the control unit 25A is substantially the same as that of the control unit 25 of Embodiment 1. The above-described description is made with reference to an example where the passing temperature sensor 25*a* is built in the control unit 25A; however, the location of the passing temperature sensor 25*a* is not limited to this example, and the passing temperature sensor 25*a* may be located outside the control unit 25A. In addition, the shunt control unit 252*c* may also be located outside the control unit.

Figure 5:
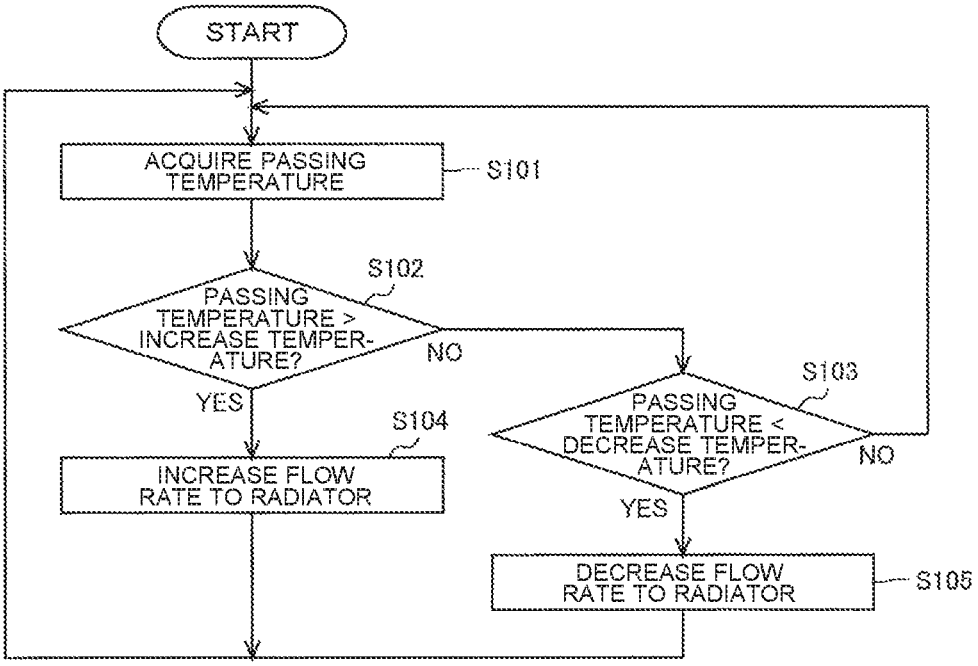
FIG. 5 is a flow chart illustrating an example of an operation of the air-conditioning apparatus of FIG. 3.

FIG. 5 is a flow chart illustrating an example of an operation of the air-conditioning apparatus of FIG. 3. With reference to FIG. 5, a control method for the shunt 26 to be performed by the control unit 25 will be described.

First, the control unit 25A acquires a passing temperature from the passing temperature sensor 25*a* (step S101). Next, the control unit 25A determines whether the passing temperature is greater than the increase threshold (step S102). In a case where the passing temperature is greater than the increase threshold (YES in step S102), the control unit 25A adjusts the split ratio of the shunt 26 in such a manner that the flow rate of the heat medium to the radiator 24 increases (step S104), and the process returns to step S101.

In a case where the passing temperature is less than or equal to the increase threshold (NO in step S102), the control unit 25A determines whether the passing temperature is smaller than the decrease threshold (step S103). In a case where the passing temperature is smaller than the decrease threshold (YES in step S103), the control unit 25A adjusts the split ratio of the shunt 26 in such a manner that the flow rate of the heat medium to the radiator 24 decreases (step S105), and the process returns to step S101.

In a case where the passing temperature is greater than or equal to the decrease threshold, that is, a case where the passing temperature is in the range from the decrease threshold to the increase threshold (NO in step S103), the process returns to step S101 while the control unit 25A maintains the current split ratio of the shunt 26. The control unit 25A repeatedly executes a series of processes in steps S101 to S105. After step S104, step S105, or NO in step S103, the process may return to step S101 after a predetermined waiting time for the control unit 25A has elapsed.

As described above, similarly to the air-conditioning apparatus 10 of Embodiment 1, even the air-conditioning apparatus 110 makes it possible to suppress the occurrence of condensation due to overcooling and, for example, no air path needs to be provided. Thus, the upsizing and breakdowns of the air-conditioning apparatus can be suppressed, and heat generated at the control unit 25A can be efficiently transferred.

The heat exchange unit 2A has the bypass pipe 27, which is connected in parallel with the radiator 24 and bypasses the heat medium. The heat exchange unit 2A is configured to adjust, using the shunt 26 installed closer to the inlet than the outlet of the radiator 24, the amount of the heat medium to flow into the bypass pipe 27 and that to flow into the radiator 24. That is, the control unit 25A is configured to adjust the split ratio of the shunt 26 on the basis of the passing temperature measured at the passing temperature sensor 25*a*. The control unit 25A is configured to increase the amount of the heat medium to flow into the radiator 24 when the passing temperature is high, and to increase the amount of the heat medium to flow into the bypass pipe 27 when the passing temperature is low. Thus, with the air-conditioning apparatus 110, the occurrence of condensation due to overcooling can be suppressed and thus breakdowns of the semiconductor device 251 and other electrical components due to the entry of condensed water can be prevented.

The description above is made with reference to an example where the split ratio of the shunt 26 is adjusted on the basis of the increase threshold and the decrease threshold; however, the split ratio does not have to be adjusted on the basis of these thresholds. The memory 252*b* may also store a split ratio adjustment table in which passing temperatures are associated with the split ratios of the shunt 26. Preferably, the split ratio adjustment table is designed in such a manner that the amount of the heat medium to flow into the radiator 24 increases as the passing temperature increases, and the amount of the heat medium to flow into the bypass pipe 27 increases as the passing temperature decreases. The control unit 25A may then acquire the split ratio of the shunt 26 by checking the passing temperature acquired from the passing temperature sensor 25*a* against the split ratio adjustment table, and may control the shunt 26 in accordance with the acquired split ratio. In this manner, the split ratio of the shunt 26 can be adjusted with high accuracy in association with the passing temperature measured at the passing temperature sensor 25*a*.

Embodiment 3

Figure 6:
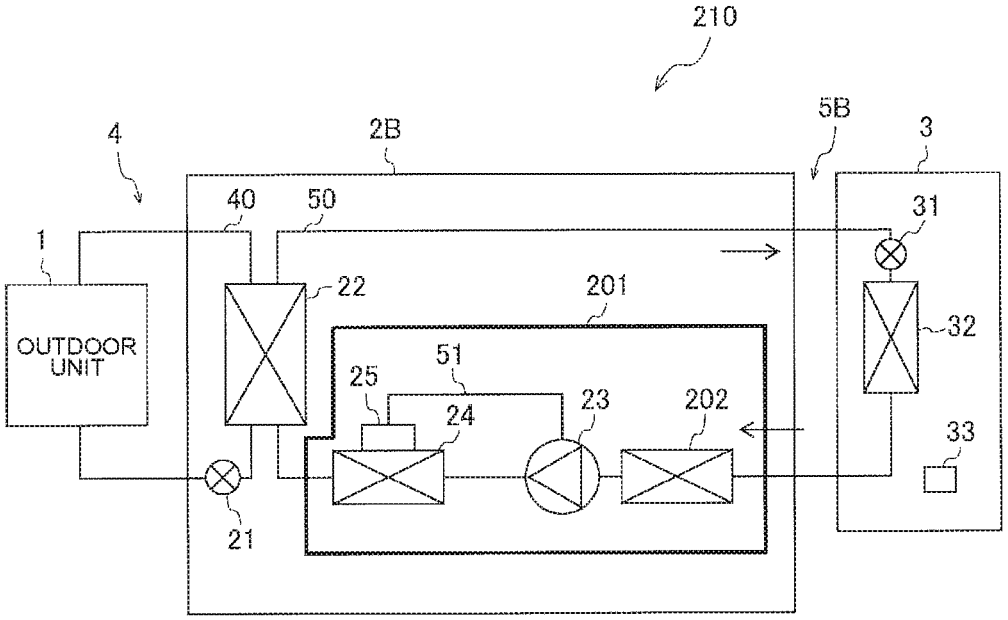
FIG. 6 is a schematic diagram illustrating an example of the configuration of an air-conditioning apparatus according to Embodiment 3 of the present invention.
Figure 7:
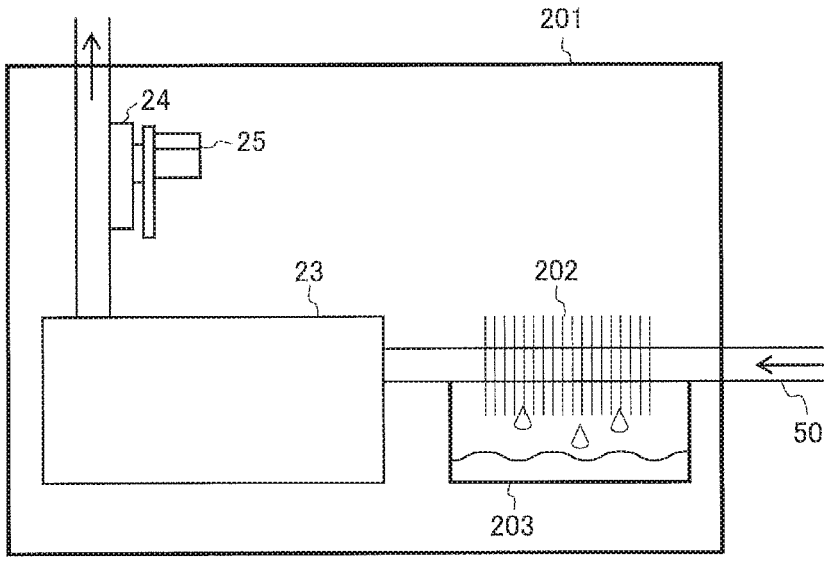
FIG. 7 is a schematic diagram illustrating an example of the configuration of the inside of a control box of FIG. 6.

FIG. 6 is a schematic diagram illustrating an example of the configuration of an air-conditioning apparatus according to Embodiment 3 of the present invention. FIG. 7 is a schematic diagram illustrating an example of the configuration of the inside of a control box of FIG. 6. The configuration of an air-conditioning apparatus 210 according to Embodiment 3 will be described with reference to FIGS. 6 and 7. Components that are substantially the same as those of the air-conditioning apparatus 10 in Embodiment 1 described above will be denoted by the same reference signs and the description of the components will be omitted.

As illustrated in FIG. 6, in the air-conditioning apparatus 210, the pump 23, the radiator 24, the control unit 25, and the inverter power wire 51 are located in a sealed control box 201. A heat exchange unit 2B has, on a heat medium circuit 5B, an inside-box heat exchanger 202 located downstream of the radiator 24 and upstream of the load-side heat exchanger 32. The inside-box heat exchanger 202 exchanges heat between air inside the control box 201 and a heat medium flowing in the heat medium circuit 5B. That is, the pump 23, the radiator 24, the control unit 25, and the inside-box heat exchanger 202 are housed in the control box 201. The inside-box heat exchanger 202 is located upstream of the pump 23 and the radiator 24 in the control box 201.

As illustrated in FIG. 7, condensation occurs at and around the inside-box heat exchanger 202 located inside the control box 201. Thus, the heat exchange unit 2 includes a water receiving unit 203 for receiving condensed water occurred at and around the inside-box heat exchanger 202. The water receiving unit 203 is located to prevent condensed water from entering electrical items inside the control box 201.

That is, the air-conditioning apparatus 210 is configured to exchange heat between a heat medium having the lowest temperature in the control box 201 before heat is received from the pump 23 and the radiator 24 and air inside the control box 201, and cause condensation on purpose at the inside-box heat exchanger 202.

The water receiving unit 203 may have a mechanism for discharging the stored condensed water to the outside, and may also have a heating unit such as a heater for evaporating the stored condensed water. The configuration of the rest of the heat exchange unit 2B and that of the heat medium circuit 5B are substantially the same as that of the heat exchange unit 2 and that of the heat medium circuit 5 of Embodiment 1, respectively.

As described above, similarly to the air-conditioning apparatus 10 of Embodiment 1, even the air-conditioning apparatus 210 makes it possible to suppress the occurrence of condensation due to overcooling and, for example, no air path needs to be provided. Thus, the upsizing and breakdowns of the air-conditioning apparatus can be suppressed, and heat generated at the control unit 25 can be efficiently transferred.

In addition, in the air-conditioning apparatus 210, both the radiator 24 and electrical components are located in the control box 201, which is sealed. In the control box 201, the inside-box heat exchanger 202 for exchanging heat between air inside the control box 201 and the heat medium circuit is located. That is, in the air-conditioning apparatus 210, the inside-box heat exchanger 202 causes condensation on purpose and the humidity inside the control box 201, which is sealed, decreases, and as a result condensation does not occur at portions other than the inside-box heat exchanger 202. That is, the humidity inside the control box 201 can be reduced by the inside-box heat exchanger 202, and thus the occurrence of condensation can be prevented at the control unit 25 and other electrical components present in the same space as the inside-box heat exchanger 202. In addition, an increase in ambient temperature inside the control box 201 can be prevented, and thus the number of heat transfer components can be reduced and the size of the configuration and cost can be reduced. In this manner, the temperature inside the control box 201 decreases, and thus an increase in the temperature of electrical components can be suppressed. As a result, no heat sink for transferring heat and no fan are additionally needed, and cost can be suppressed.

Furthermore, the inside-box heat exchanger 202 is located at part of the heat medium pipe 50 closer to an inlet than an outlet of the pump 23. That is, the inside-box heat exchanger 202 is configured to perform heat exchange at part of the heat medium pipe 50 before exhaust heat is received from the pump 23 and the control unit 25, and thus the humidity and temperature inside the control box 201 can be efficiently reduced.

In addition, the air-conditioning apparatus 210 is provided with the water receiving unit 203 so that, even when condensed water drops from the inside-box heat exchanger 202, the condensed water does not enter the electrical components. Thus, the condensed water caused by the inside-box heat exchanger 202 can be prevented from entering the control unit 25 and other electrical components, and breakdowns of the electrical components can be suppressed.

Similarly to the air-conditioning apparatus 110 of Embodiment 2, the air-conditioning apparatus 210 may have the shunt 26, the bypass pipe 27, and the passing temperature sensor 25*a*. The control unit 25 may adjust the split ratio of the shunt 26 on the basis of the passing temperature measured at the passing temperature sensor 25*a*.

Embodiment 4

Figure 8:
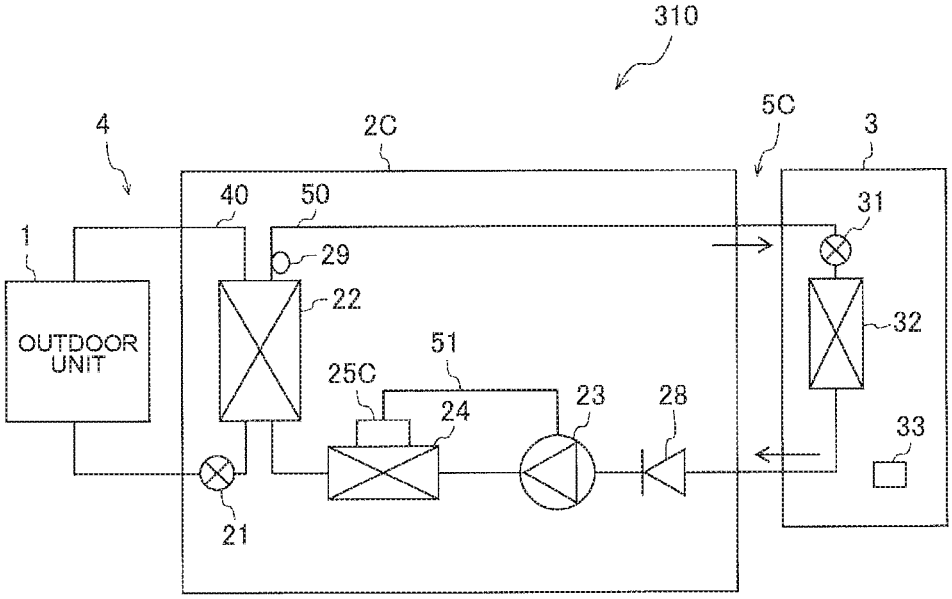
FIG. 8 is a schematic diagram illustrating an example of the configuration of an air-conditioning apparatus according to Embodiment 4 of the present invention.

FIG. 8 is a schematic diagram illustrating an example of the configuration of an air-conditioning apparatus according to Embodiment 4 of the present invention. The configuration of an air-conditioning apparatus 310 according to Embodiment 4 will be described with reference to FIG. 8. Components that are substantially the same as those of the air-conditioning apparatus 10 in Embodiment 1 described above will be denoted by the same reference signs and the description of the components will be omitted.

In the air-conditioning apparatus 310, the radiator 24 and the pump 23 are installed at part of the heat medium pipe 50 closer to the inlet than the outlet of the circuit-circuit heat exchanger 22. A heat exchange unit 2C has a check valve 28 upstream of the radiator 24 and the pump 23 on a heat medium circuit 5C. The check valve 28 is attached in such a manner that a heat medium flows only in the direction from the indoor unit 3 toward the pump 23. That is, the check valve 28 is located downstream of the load-side heat exchanger 32 and upstream of the pump 23, and stops the flow of a heat medium from the pump 23 toward the load-side heat exchanger 32. In addition, the heat exchange unit 2C has a flowing-out temperature sensor 29 that is located at part of the heat medium pipe 50 closer to the outlet than the inlet of the circuit-circuit heat exchanger 22 and measures a flowing-out temperature that is the temperature of a heat medium flowing out from the circuit-circuit heat exchanger 22. Preferably, the flowing-out temperature sensor 29 is located close to or at the outlet of the circuit-circuit heat exchanger 22.

Furthermore, when the control unit 25C and the pump 23 are energized, the control unit 25C and the pump 23 are configured to generate heat without rotating the motor 23*a*. That is, the control unit 25C is configured to perform constraint energization to the pump 23. In constraint energization, the control unit 25C outputs torque that is insufficient to rotate the motor 23*a*, and outputs, to the wound wire of the motor 23*a*, an energization pattern with which the motor 23*a* is not rotated but constrained. As a result, at least one of the control unit 25C and the pump 23 can be heated.

The memory 252*b* prestores the lowest reference temperature that is used as a reference for temperature decrease of the heat medium inside the circuit-circuit heat exchanger 22. The lowest reference temperature is set to the lowest temperature at which the heat medium inside the circuit-circuit heat exchanger 22 does not freeze.

When the flowing-out temperature measured at the flowing-out temperature sensor 29 becomes lower than the lowest reference temperature while the pump 23 is stopped, the control unit 25C is configured to perform constraint energization to the pump 23.

The configuration of the rest of the heat exchange unit 2C and that of the heat medium circuit 5C are substantially the same as that of the heat exchange unit 2 and that of the heat medium circuit 5 of Embodiment 1, respectively. That is, the configuration of the rest of the control unit 25C is substantially the same as that of the control unit 25 of Embodiment 1.

Figure 9:
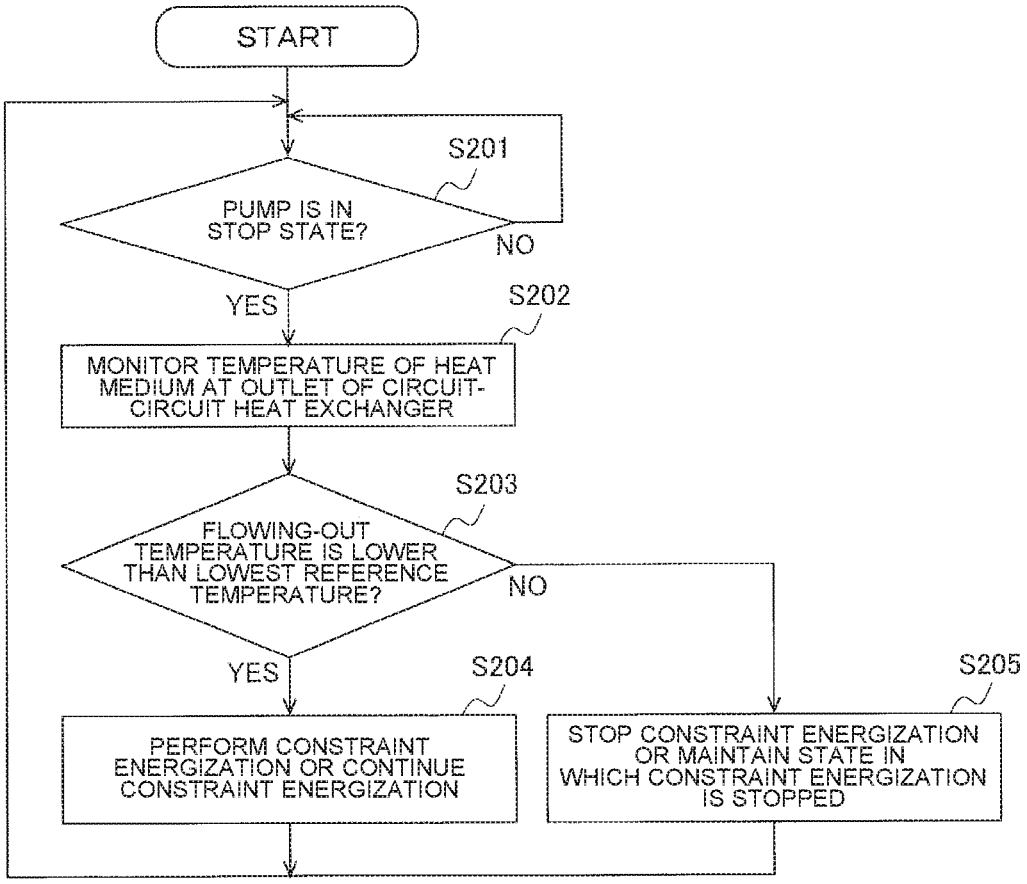
FIG. 9 is a flow chart illustrating an example of an operation of the air-conditioning apparatus of FIG. 8.

FIG. 9 is a flow chart illustrating an example of an operation of the air-conditioning apparatus of FIG. 8. With reference to FIG. 9, a heating process at the pump 23 performed by the control unit 25C will be described.

The control unit 25C checks an operation state of the pump 23. In a case where the pump 23 is in operation (NO in step S201), the control unit 25C keeps monitoring the operation state of the pump 23. In contrast, in a case where the pump 23 is in a stop state (YES in step S201), the control unit 25C monitors the temperature of the heat medium at the outlet of the circuit-circuit heat exchanger 22.

That is, the control unit 25C acquires a flowing-out temperature from the flowing-out temperature sensor 29 (step S202).

Next, the control unit 25C determines whether the flowing-out temperature acquired from the flowing-out temperature sensor 29 is lower than the lowest reference temperature (step S203). In a case where the flowing-out temperature is lower than the lowest reference temperature (YES in step S203), the control unit 25C performs constraint energization to the wound wire of the motor 23*a* to cause the control unit 25C and the pump 23 to generate heat (step S204), and the process returns to step S201. In contrast, in a case where the flowing-out temperature is greater than or equal to the lowest reference temperature (NO in step S203), the control unit 25C does not perform constraint energization for heat generation (step S205), and the process returns to step S201.

The control unit 25C repeatedly executes a series of processes in steps S201 to S205. That is, in a case where it is determined that the flowing-out temperature is greater than or equal to the lowest reference temperature while constraint energization is being performed (NO in step S203), the control unit 250 stops the constraint energization (step S205), and the process returns to step S201. In a case where it is determined in step S203 that the flowing-out temperature is lower than the lowest reference temperature while constraint energization is being performed (YES in step S203), the control unit 250 continues the constraint energization (step S204), and the process returns to step S201.

As described above, similarly to the air-conditioning apparatus 10 of Embodiment 1, even the air-conditioning apparatus 310 makes it possible to suppress the occurrence of condensation due to overcooling and, for example, no air path needs to be provided. Thus, the upsizing and breakdowns of the air-conditioning apparatus can be suppressed, and heat generated at the control unit 25C can be efficiently transferred.

Here, in a case where the heat exchange unit 2 equipped with the circuit-circuit heat exchanger 22 is installed outdoors, there is a concern that, while an operation is stopped, the heat medium inside a pipe of the circuit-circuit heat exchanger 22 freezes and expands and the pipe of the circuit-circuit heat exchanger 22 becomes damaged. This concern becomes pronounced especially in a case where the heat exchange unit 2 is installed under an environment with low outdoor air temperature. When the heat medium in the pipe of the circuit-circuit heat exchanger 22 freezes and expands and the pipe of the circuit-circuit heat exchanger 22 becomes damaged, the heat medium mixes with refrigerant.

In this respect, the air-conditioning apparatus 310 is configured to monitor the temperature of the heat medium using the flowing-out temperature sensor 29 installed at the heat medium pipe 50 at the outlet of the circuit-circuit heat exchanger 22. In a case where the flowing-out temperature measured at the flowing-out temperature sensor 29 has become lower than the lowest reference temperature, the air-conditioning apparatus 310 heats the heat medium by causing at least one of the control unit 25C and the pump 23 to generate heat on purpose. Consequently, with the air-conditioning apparatus 310, the circuit-circuit heat exchanger 22 can be prevented from freezing and damage of the pipe of the circuit-circuit heat exchanger 22 can be suppressed.

In addition, the air-conditioning apparatus 310 has the check valve 28 located downstream of the load-side heat exchanger 32 and upstream of the pump 23.

Consequently, backflow of the heat medium heated through constraint energization performed by the control unit 25C to the indoor unit 3 side can be prevented, and thus a situation in which heat is not transmitted to the circuit-circuit heat exchanger 22 can be prevented.

In this case, similarly to the air-conditioning apparatus 110 of Embodiment 2, the air-conditioning apparatus 310 may have the shunt 26, the bypass pipe 27, and the passing temperature sensor 25*a*. The control unit 25C may adjust the split ratio of the shunt 26 on the basis of the passing temperature measured at the passing temperature sensor 25*a*. In addition, similarly to the air-conditioning apparatus 210 of Embodiment 3, the air-conditioning apparatus 310 may have the inside-box heat exchanger 202 and may further have the water receiving unit 203. Preferably, the pump 23, the radiator 24, the control unit 25C, and the inside-box heat exchanger 202 are housed in the control box 201.

<Modification 1>

Figure 10:
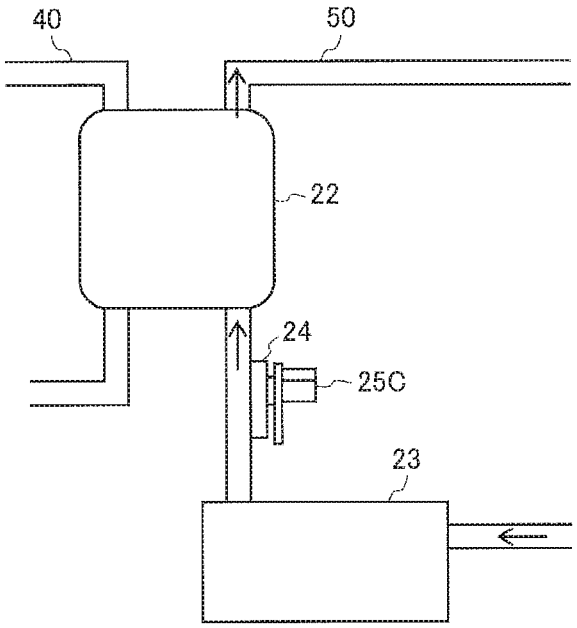
FIG. 10 is a schematic diagram partially illustrating a configuration around a circuit-circuit heat exchanger of an air-conditioning apparatus according to Modification 1 of Embodiment 4 of the present invention.
Figure 11:
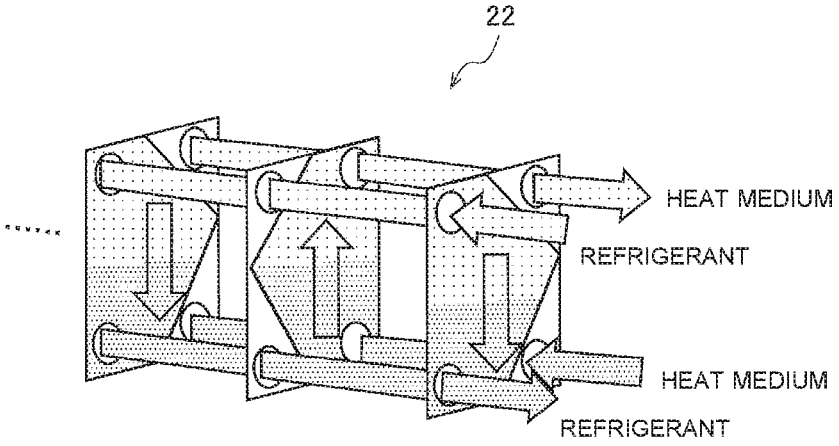
FIG. 11 is an illustrative diagram illustrating an example of the configuration of the circuit-circuit heat exchanger of FIG. 10.

FIG. 10 is a schematic diagram partially illustrating a configuration around a circuit-circuit heat exchanger of an air-conditioning apparatus according to Modification 1 of Embodiment 4 of the present invention. FIG. 11 is an illustrative diagram illustrating an example of the configuration of the circuit-circuit heat exchanger of FIG. 10. The basic configuration of the air-conditioning apparatus according to Modification 1 is substantially the same as that of the air-conditioning apparatus 310, and thus substantially the same components will be denoted by the same reference signs and the description of the components will be omitted. In this case, the pump 23 is used to heat the heat medium inside the heat medium circuit 5C through constraint energization performed by the control unit 25C. In addition, as the radiator 24 is in contact with the control unit 25C, the radiator 24 is used to heat the heat medium inside the heat medium circuit 5C by using heat generated by the control unit 25C due to constraint energization.

As illustrated in FIG. 10, in the air-conditioning apparatus 310 of Modification 1, the radiator 24 and the pump 23 are located physically lower than the circuit-circuit heat exchanger 22. In the heat medium circuit 50, part of the heat medium pipe 50 through the circuit-circuit heat exchanger 22, the radiator 24, and the pump 23 does not meander and is formed in a straight shape. Furthermore, even inside the circuit-circuit heat exchanger 22, the heat medium pipe 50 does not to meander. For example, the circuit-circuit heat exchanger 22 of Modification 1 has a configuration similar to that of a plate heat exchanger illustrated in FIG. 11.

That is, the heat medium pipe 50 is formed in a straight shape inside the circuit-circuit heat exchanger 22 so that the heat medium flows straight. In addition, in the heat medium circuit 50, the radiator 24 and the pump 23 are located below the circuit-circuit heat exchanger 22. Furthermore, in the heat medium circuit 5C, part of the heat medium pipe 50 through the circuit-circuit heat exchanger 22, the radiator 24, and the pump 23 is formed in a straight shape so that the heat medium flows straight.

In this case, when the heat medium is heated using heat generated by the control unit 25C and the pump 23, natural convection occurs in the heat medium circuit 5C. The heat medium circuit 5C of Modification 1 has a configuration with which, as described above, the resistance of the flow path from the pump 23 to the circuit-circuit heat exchanger 22 becomes small and heat movement due to the natural convection cannot be obstructed. That is, in the heat medium circuit 50, the control unit 25C and the pump 23, which are used as a heat source, are located lower than the circuit-circuit heat exchanger 22. Thus, natural convection is caused by the heat medium heated by the heat source in the heat medium circuit 5C, and the heat medium flows toward the circuit-circuit heat exchanger 22 located higher than the heat source. Thus, with the air-conditioning apparatus 310 of Modification 1, as heat generated through constraint energization can be efficiently transferred to the circuit-circuit heat exchanger 22 without exerting pressure by, for example, the pump 23, an energizing time for heating can be shortened. Consequently, the life of electrical components can be prolonged and power consumption can be reduced.

<Modification 2>

The basic configuration of an air-conditioning apparatus according to Modification 2 is substantially the same as that of the air-conditioning apparatus 310, and thus substantially the same components will be denoted by the same reference signs and the description of the components will be omitted. The control unit 25C of Modification 2 is configured to cause at least one of the control unit 25C and the pump 23 to generate heat and start time measurement when the flowing-out temperature acquired from the flowing-out temperature sensor 29 becomes lower than the lowest reference temperature. The control unit 25C is configured to drive the pump 23 and push the heated heat medium into the circuit-circuit heat exchanger 22 after a predetermined setting time has elapsed since the start of time measurement.

The amount of the heat medium that the control unit 25C causes the pump 23 to push out is preset on the basis of, for example, the size of the circuit-circuit heat exchanger 22, the size of the pump 23, and the length of the heat medium pipe 50 from the circuit-circuit heat exchanger 22 to the pump 23. The amount of the heat medium from the pump 23 to the circuit-circuit heat exchanger 22 can be acquired at the design stage of the heat exchange unit 2C, and thus the amount of the heat medium to be pushed out by the pump 23 can be preset. That is, the control unit 25C is configured to discharge, toward the circuit-circuit heat exchanger 22, a certain amount of the heat medium heated at the pump 23 that is enough to reach the inside of the circuit-circuit heat exchanger 22 after the setting time has elapsed since the start of time measurement.

Figure 12:
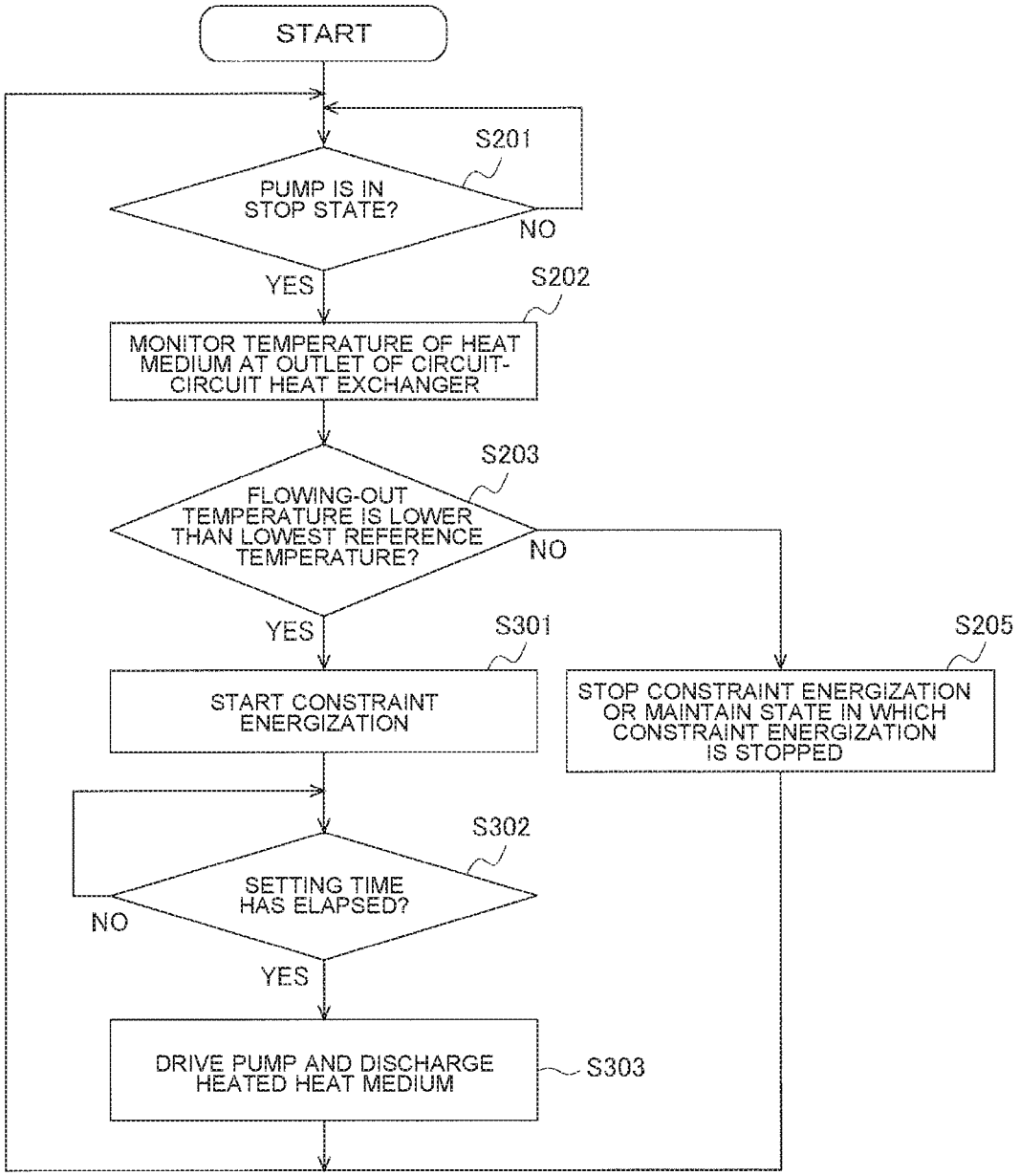
FIG. 12 is a flow chart illustrating an operation of an air-conditioning apparatus according to Modification 2 of Embodiment 4 of the present invention.

FIG. 12 is a flow chart illustrating an operation of an air-conditioning apparatus according to Modification 2 of Embodiment 4 of the present invention. With reference to FIG. 12, a heating process at the pump 23 performed by the control unit 25C of Modification 2 will be described. Operations similar to those in FIG. 9 will be denoted by the same reference signs and the description of the operations will be omitted.

The control unit 25C executes processes in steps S201 to S203 as in the case of FIG. 9. Next, in a case where the flowing-out temperature acquired from the flowing-out temperature sensor 29 is lower than the lowest reference temperature (YES in step S203), the control unit 25C performs constraint energization to the wound wire of the motor 23*a* and also starts time measurement (step S301). Until the setting time elapses, the control unit 25C is on standby in a state in which constraint energization is continued (NO in step S302). When the setting time elapses (YES in step S302), the control unit 25C drives the pump 23. The control unit 250 discharges the preset amount of the heat medium, that is, the heated heat medium, toward the circuit-circuit heat exchanger 22 (step S303), and the process returns to step S201.

In contrast, in a case where the flowing-out temperature is greater than or equal to the lowest reference temperature (NO in step S203), the control unit 25C maintains a state in which constraint energization is not performed (step S205), and the process returns to step S201. The control unit 250 repeatedly executes a series of processes illustrated in FIG. 12.

Due to, for example, the length of the heat medium pipe 50 or the other configuration of the heat medium circuit 5C, there may be a case where heat is less likely to be transferred to the circuit-circuit heat exchanger 22 only when the heat medium is heated or also a case where it takes time to transfer heat to the circuit-circuit heat exchanger 22. In this respect, by driving the pump 23, the air-conditioning apparatus 310 of Modification 2 can convey the heat medium heated by the heat source to the circuit-circuit heat exchanger 22, and thus the temperature of the circuit-circuit heat exchanger 22 can be efficiently increased and an energizing time for heating can be shortened. Consequently, the life of electrical components can be prolonged and power consumption can be reduced. That is, with the air-conditioning apparatus 310 of Modification 2, even in a case where it is difficult to convey the heat medium heated by the heat source to the circuit-circuit heat exchanger 22 using natural convection because of the configuration of the heat medium pipe 50 and circuit-circuit heat exchanger 22, freezing can be prevented. As a matter of course, the air-conditioning apparatus 310 of Modification 2 may also have structural characteristics similar to those of Modification 1 described above.

<Modification 3>

The basic configuration of an air-conditioning apparatus according to Modification 3 is substantially the same as that of the air-conditioning apparatus 310, and thus substantially the same components will be denoted by the same reference signs and the description of the components will be omitted. The air-conditioning apparatus 310 of Modification 3 is configured to start heating the heat medium using the control unit 25C and the pump 23 when the heating operation mode is switched to the defrosting operation mode in a case where, for example, frost forms on the heat-source-side heat exchanger 13 of the outdoor unit 1. That is, the control unit 25C of Modification 3 is configured to perform constraint energization to the wound wire of the motor 23*a* when the heating operation mode is switched to the defrosting operation mode.

In this case, at the time of a defrosting operation, the indoor temperature decreases as the indoor unit 3 cannot continue a heating operation. The air-conditioning apparatus 310 of Modification 3 is configured to heat the heat medium through constraint energization in addition to a normal defrosting operation. In this manner, the air-conditioning apparatus 310 of Modification 3 adopts processing for constraint energization in the defrosting operation, and thus increases the temperature of the heat medium inside the circuit-circuit heat exchanger 22 at the time of the defrosting operation, and can apply heat to the refrigerant through the circuit-circuit heat exchanger 22. Thus, as the temperature of the heat-source-side heat exchanger 13 can be increased, a time for the defrosting operation can be shortened. The air-conditioning apparatus 310 of Modification 3 may have a configuration similar to that of Modification 1 or 2. In this manner, advantageous effects similar to those in Modifications 1 or 2 can be obtained.

<Modification 4>

The basic configuration of an air-conditioning apparatus according to Modification 4 is substantially the same as that of the air-conditioning apparatus 310, and thus substantially the same components will be denoted by the same reference signs and the description of the components will be omitted. The air-conditioning apparatus 310 of Modification 4 is configured to cause the control unit 25C and the pump 23 to start heating the heat medium in a case where the outdoor unit 1 stops operating. That is, the control unit 25C of Modification 4 is configured to perform constraint energization to the wound wire of the motor 23*a* in a case where the outdoor unit 1 stops operating. The control unit 25C can monitor the operation state of the outdoor unit 1 through the outdoor controller 15.

The air-conditioning apparatus 310 of Modification 4 is configured to heat the heat medium through constraint energization performed by the control unit 25C and transfer heat to the refrigerant of the outdoor unit 1 through the circuit-circuit heat exchanger 22 in a case where the outdoor unit 1 stops operating. That is, with the air-conditioning apparatus 310 of Modification 4, the refrigerant inside the refrigerant circuit 4 is heated through constraint energization performed by the control unit 25C in a case where the outdoor unit 1 stops operating. As a result, refrigerant stagnation can be prevented and resolved, and thus at the compressor 11, the occurrence of damage caused by liquid compression and seizing of a shaft due to a decrease in oil density can be suppressed.

In this case, the air-conditioning apparatus 310 of Modification 4 may have a crankcase heater attached to an outer wall of the compressor 11. The outdoor controller 15 may energize the crankcase heater in a case where the outdoor unit 1 stops operating. In addition, in a case where the outdoor unit 1 stops operating, the outdoor controller 15 may apply, to the compressor 11, a voltage at which the compressor 11 is not driven. That is, in a case where the outdoor unit 1 stops operating, the outdoor controller 15 may perform constraint energization by supplying, using an inverter, a current to the wound wire of the compressor motor, In this case, the air-conditioning apparatus 310 of Modification 4 may have a configuration similar to those of Modifications 1 to 3. In this manner, advantageous effects similar to those in Modifications 1 to 3 can be obtained.

Embodiment 5

Figure 13:
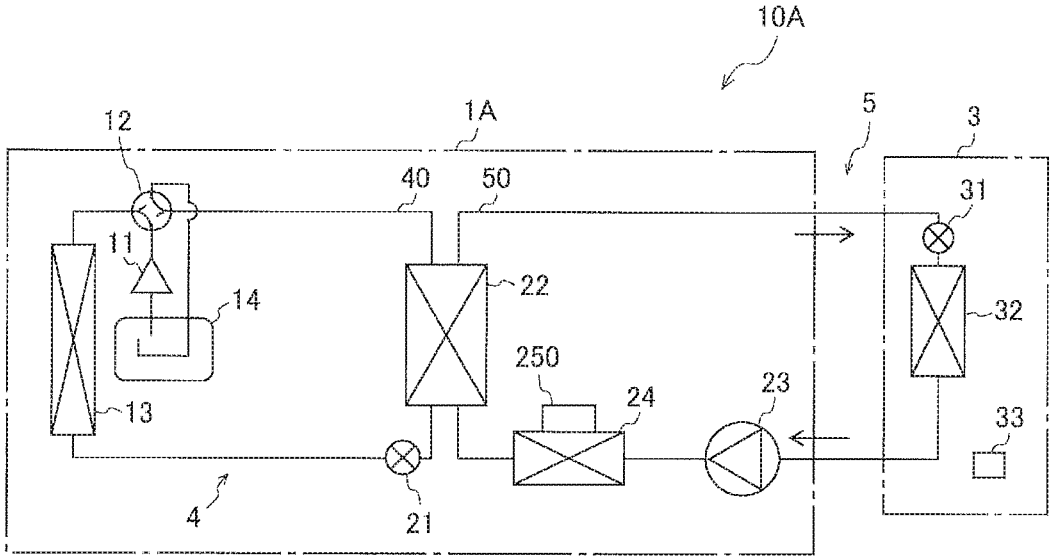
FIG. 13 is a schematic diagram illustrating an example of the configuration of an air-conditioning apparatus according to Embodiment 5 of the present invention.

FIG. 13 is a schematic diagram illustrating an example of the configuration of an air-conditioning apparatus according to Embodiment 5 of the present invention. The configuration of an air-conditioning apparatus 10A according to Embodiment 5 will be described with reference to FIG. 13. Components that are substantially the same as those of the air-conditioning apparatus 10 in Embodiment 1 described above will be denoted by the same reference signs and the description of the components will be omitted.

As illustrated in FIG. 13, the air-conditioning apparatus 10A includes a chiller unit 1A and the indoor unit 3. The chiller unit 1A and the indoor unit 3 are connected by the heat medium pipe 50. The chiller unit 1A has the compressor 11, the four-way valve 12, the heat-source-side heat exchanger 13, the accumulator 14, the heat-source-side expansion device 21, the circuit-circuit heat exchanger 22, the pump 23, the radiator 24, and a control unit 250.

The control unit 250 is used as both the outdoor controller 15 and the control unit 25 in Embodiment 1, and controls the chiller unit 1A. That is, the compressor 11, the four-way valve 12, and the pump 23 are controlled by the control unit 250. In addition, in a case where an air-sending device (not illustrated) is provided to the heat-source-side heat exchanger 13, the control unit 250 controls the fan motor of the air-sending device.

Similarly to the control unit 25 of Embodiment 1, the control unit 250 is connected to the power source 500, such as a commercial power source, via the noise canceller 600. The control unit 250 and the noise canceller 600 are housed in the control box 700.

The control unit 250 and the indoor controller 33 are configured in such a manner that communication is possible with each other. The control unit 250 and the indoor controller 33 are configured to execute the cooling operation mode, the heating operation mode, and the defrosting operation mode in cooperation with each other.

The control unit 250 has a heat sink plate (not illustrated), and is located in such a manner that the heat sink plate is in contact with the radiator 24. That is, the control unit 250 is thermally connected to the heat medium pipe 50 via the radiator 24, and is cooled via the radiator 24 by the heat medium flowing in the heat medium pipe 50.

The radiator 24 is formed by a plate-like body, and one surface of the radiator 24 is connected to the heat medium pipe 50 and the other surface is in contact with the control unit 250. The radiator 24 exchanges heat between the control unit 250 and the heat medium flowing in the heat medium circuit 5. The surface of the radiator 24 facing the control unit 250 is planar and is in contact with the heat sink plate of the control unit 250.

As described above, similarly to the air-conditioning apparatus 10 of Embodiment 1, even the air-conditioning apparatus 10A makes it possible to suppress the occurrence of condensation due to overcooling and, for example, no air path needs to be provided. Thus, the upsizing and breakdowns of the air-conditioning apparatus can be suppressed, and heat generated at the control unit 250 can be efficiently transferred.

In the air-conditioning apparatus 10 of Embodiment 1, as the outdoor controller 15 is located at the outdoor unit 1, the outdoor controller 15 cannot be cooled by the heat medium flowing in the heat medium circuit 5. In contrast, in the air-conditioning apparatus 10A of Embodiment 5, the compressor 11 and the pump 23 are located in the chiller unit 1A, and the control unit 250 is configured to control the compressor 11 and the pump 23. Thus, with the air-conditioning apparatus 10A, the control unit 250 that has generated heat through driving control of the compressor motor of the compressor 11 can be cooled by the heat medium passing through the heat medium pipe 50. In addition, an air-sending device that sends air to the heat-source-side heat exchanger 13 and that is controlled by the control unit 250 can be provided to the chiller unit 1A. In this case, the air-conditioning apparatus 10A can cool, with the heat medium passing through the heat medium pipe 50, the control unit 250 that has generated heat through driving control of the fan motor of the air-sending device.

In this case, FIG. 13 shows, as an example, the case where the pump 23 is located at the chiller unit 1A; however, the position of the pump 23 is not limited to this example. The pump 23 may also be located at a position of the heat medium pipe 50 at which the chiller unit 1A is connected to the indoor unit 3. In this case, preferably, the pump 23 is controlled not by the control unit 250 but by an external controller. In addition, the pump 23 may also be located at the heat medium pipe 50 located at the indoor unit 3. In this case, preferably, the pump 23 is controlled by the indoor controller 33.

The embodiments described above are preferred specific examples of an air-conditioning apparatus, and the technical scope of the present invention is not limited to these embodiments. In each of the embodiments described above, the case where the pump 23 is located upstream of the radiator 24 is described; however, the position of the pump 23 is not limited to this case and the pump 23 may also be located downstream of the radiator 24. In addition, the pump 23 may also be located closer to the outlet than the inlet of the circuit-circuit heat exchanger 22. The pump 23 may also be located away from the radiator 24 in such a manner that the pump 23 is located closer to the outlet than the inlet of the circuit-circuit heat exchanger 22 and the radiator 24 is located closer to the inlet than the outlet of the circuit-circuit heat exchanger. In this manner, the effect of vibrations and heat of the pump 23 on the control units 25 and 25A to 25C can be reduced.

REFERENCE SIGNS LIST

1 outdoor unit 1A chiller unit 2, 2A to 2C heat exchange unit 3 indoor unit 4 refrigerant circuit 5, 5A to 5C heat medium circuit 10, 10A, 110, 210, 310 air-conditioning apparatus 11 compressor 12 four-way valve 13 heat-source-side heat exchanger 14 accumulator 15 outdoor controller 21 heat-source-side expansion device 22 circuit-circuit heat exchanger 23 pump 23*a* motor 24 radiator 25, 25A, 25C, 250 control unit 25*a* passing temperature sensor 26 shunt 27 bypass pipe 28 check valve 29 flowing-out temperature sensor 31 load-side expansion device 32 load-side heat exchanger 33 indoor controller 40 refrigerant pipe 50 heat medium pipe 51 inverter power wire 201, 700 control box 202 inside-box heat exchanger 203 water receiving unit 251 semiconductor device 252, 252A control circuit 252*a* inverter control unit 252*b* memory 252*c* shunt control unit 500 power source 600 noise canceller

The invention claimed is:

1. An air-conditioning apparatus, comprising:

a refrigerant circuit in which a compressor, a heat-source-side heat exchanger, a heat-source-side expansion valve, and a circuit-circuit heat exchanger are connected via a refrigerant pipe and refrigerant circulates;

a heat medium circuit in which a pump, the circuit-circuit heat exchanger, a load-side expansion valve, and a load-side heat exchanger are connected via a heat medium pipe and a heat medium circulates;

a radiator that is connected to the heat medium pipe; and a semiconductor controller that is attached to the radiator, the circuit-circuit heat exchanger exchanging heat between the refrigerant circulating in the refrigerant circuit and the heat medium circulating in the heat medium circuit, the semiconductor controller being cooled via the radiator by the heat medium flowing in the heat medium pipe, the radiator being located downstream of the load-side heat exchanger and between the load-side heat exchanger and an inlet of the circuit-circuit heat exchanger, and the air-conditioning apparatus further comprising:

an outdoor unit having the compressor and the heat-source-side heat exchanger;

a heat exchange unit having the heat-source-side expansion valve, the circuit-circuit heat exchanger, the pump, the radiator, and the semiconductor controller; and an indoor unit having the load-side expansion valve and the load-side heat exchanger.

2. The air-conditioning apparatus of claim 1, wherein the semiconductor controller is configured to control the pump.

3. The air-conditioning apparatus of claim 1, wherein the heat medium circuit further includes a bypass pipe for bypassing an inlet and an outlet of the radiator, and a shunt that is installed closer to the inlet than the outlet of the radiator and is for splitting a heat medium flowing in from upstream of the radiator into a heat medium for the radiator and a heat medium for the bypass pipe, and the semiconductor controller includes a semiconductor shunt controller configured to adjust a split ratio of the shunt in accordance with a temperature of the heat medium passing through the radiator.

4. The air-conditioning apparatus of claim 3, wherein the heat exchange unit further includes a passing temperature sensor configured to measure a passing temperature that is a temperature of the heat medium passing through the radiator, the semiconductor controller further includes a memory configured to store an increase threshold that is used as a reference for increasing a flow rate of the heat medium to the radiator and a decrease threshold that is set at a lower temperature than the increase threshold and that is used as a reference for reducing the flow rate of the heat medium to the radiator, and the semiconductor shunt controller is configured to adjust, in a case where the passing temperature is greater than the increase threshold, the split ratio of the shunt in such a manner that the flow rate of the heat medium to the radiator is increased, and adjust, in a case where the passing temperature is smaller than the decrease threshold, the split ratio of the shunt in such a manner that the flow rate of the heat medium to the radiator is reduced.

5. The air-conditioning apparatus of claim 4, wherein the memory is configured to store a split ratio table in which temperature differences from the increase threshold and the decrease threshold are associated with split ratios of the shunt, and the semiconductor controller is configured to acquire, in a case where the passing temperature is greater than the increase threshold, the split ratio of the shunt by checking a temperature difference between the passing temperature and the increase threshold against the split ratio table, and acquire, in a case where the passing temperature is smaller than the decrease threshold, the split ratio of the shunt by checking a temperature difference between the passing temperature and the decrease threshold against the split ratio table.

6. The air-conditioning apparatus of claim 3, wherein the heat exchange unit further includes a passing temperature sensor configured to measure a passing temperature that is a temperature of the heat medium passing through the radiator, and the semiconductor controller further includes a memory configured to store a split ratio adjustment table in which the passing temperature is associated with the split ratio of the shunt in such a manner that an amount of the heat medium to flow into the radiator increases as the passing temperature increases, and an amount of the heat medium to flow into the bypass pipe increases as the passing temperature decreases, and the semiconductor shunt controller is configured to acquire the split ratio of the shunt by checking the passing temperature against the split ratio adjustment table.

* * * * *